US009303530B2

(12) United States Patent
Albert et al.

(10) Patent No.: US 9,303,530 B2
(45) Date of Patent: Apr. 5, 2016

(54) FAN SHROUD ASSEMBLY

(71) Applicant: GM GLOBAL TECHNOLOGY OPERATIONS LLC, Detroit, MI (US)

(72) Inventors: John M. Albert, Sterling Heights, MI (US); Joseph H. Alexander, Rochester Hills, MI (US); Sebastian Dinh Hoang, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 45 days.

(21) Appl. No.: 14/153,467

(22) Filed: Jan. 13, 2014

(65) Prior Publication Data

US 2015/0198066 A1 Jul. 16, 2015

(51) Int. Cl.
*F01D 25/24* (2006.01)
*F01P 5/06* (2006.01)

(52) U.S. Cl.
CPC .. *F01D 25/24* (2013.01); *F01P 5/06* (2013.01)

(58) Field of Classification Search
CPC .. F04D 29/646; F01P 2070/50; F01P 2070/52
USPC ..... 123/41.01, 41.21, 41.49, 41.63, 41.65; 415/119, 213.1, 173.3, 214.1, 201, 415/208.1, 173.7
See application file for complete search history.

(56) References Cited

U.S. PATENT DOCUMENTS

| | | | | |
|---|---|---|---|---|
| 4,397,348 | A * | 8/1983 | Klem | 165/41 |
| 5,244,347 | A * | 9/1993 | Gallivan et al. | 416/189 |
| 5,671,803 | A * | 9/1997 | Tepas et al. | 165/41 |
| 7,640,966 | B2 * | 1/2010 | Maeda et al. | 165/41 |
| 8,221,074 | B2 * | 7/2012 | Nelson | 415/213.1 |
| 8,303,244 | B2 | 11/2012 | Alexander et al. | |
| 2003/0019606 | A1 * | 1/2003 | Stauder et al. | 165/41 |
| 2009/0162195 | A1 * | 6/2009 | Nelson | 415/219.1 |
| 2011/0280719 | A1 * | 11/2011 | Farlow et al. | 415/208.1 |

* cited by examiner

*Primary Examiner* — Lindsay Low
*Assistant Examiner* — Long T Tran
(74) *Attorney, Agent, or Firm* — Quinn Law Group, PLLC

(57) ABSTRACT

A fan shroud assembly includes a first fan shroud and a second fan shroud. The first fan shroud includes a first segment, a second segment, and a flexible, gas impermeable seal interconnecting the first and second segments. The first segment includes an annular body. The flexible, gas impermeable seal is coupled to the first segment. The second segment includes a circumferential connecting wall and a flange extending from the circumferential connecting wall. The second fan shroud is coupled to the second segment.

15 Claims, 4 Drawing Sheets

FAN SHROUD ASSEMBLY

TECHNICAL FIELD

The present disclosure relates to a fan shroud assembly.

BACKGROUND

Vehicles, such as automobiles, include a fan shroud assembly, which is part of a condenser, radiator, and fan module (CRFM). The CRFM includes a fan, a radiator, and a condenser. The fan can generate airflow, and the fan shroud assembly covers at least part of the fan.

SUMMARY

The CRFM includes a fan shroud assembly that can help interconnect a vehicle body and an engine. Although the vehicle body should be operatively coupled to the engine, it is useful to allow relative movement between the engine and the vehicle body in order to minimize vibrations in the vehicle body. The presently disclosed fan shroud assembly can aid in coupling the engine to the vehicle body, while allowing the engine to move relative to the vehicle body.

In an embodiment, the fan shroud assembly includes a first fan shroud having a first segment, a second segment, and a flexible, gas impermeable seal interconnecting the first and second segments. The first segment includes an annular body. The annular body defines a first circumferential edge and a second circumferential edge. The flexible, gas impermeable seal is coupled to the first segment along an entirety of the second circumferential edge of the annular body. The second segment includes a circumferential connecting wall and a flange extending from the circumferential connecting wall. The connecting wall includes a first circumferential edge and a second circumferential edge. The flexible, gas impermeable seal is coupled to the second segment along an entirety of the first circumferential edge of the circumferential connecting wall. The flange is coupled to the circumferential connecting wall along an entirety of the second circumferential edge of the circumferential connecting wall. The fan shroud assembly further includes a second fan shroud coupled to the second segment. The second fan shroud includes a shroud body and a circumferential support wall extending from the shroud body. The flange is disposed on the shroud body. The circumferential connecting wall is disposed on the circumferential support wall such that the circumferential connecting wall surrounds the circumferential support wall.

The present disclosure also relates to a condenser, radiator, and fan module (CRFM). In an embodiment, the CRFM includes a first fan shroud having a first segment, a second segment, and a flexible, gas impermeable seal interconnecting the first and second segments. The first segment includes an annular body. The CRFM further includes a second fan shroud coupled to the second segment, a fan disposed within the annular body, and a radiator coupled to the second fan shroud.

The present disclosure also relates to vehicles, such as cars. In an embodiment, the vehicle includes a vehicle body, an engine disposed within the vehicle body, and a CRFM as described above. The CRFM is disposed within the vehicle body.

The above features and advantages and other features and advantages of the present invention are readily apparent from the following detailed description of the best modes for carrying out the invention when taken in connection with the accompanying drawings.

DETAILED DESCRIPTION

Figure 1:
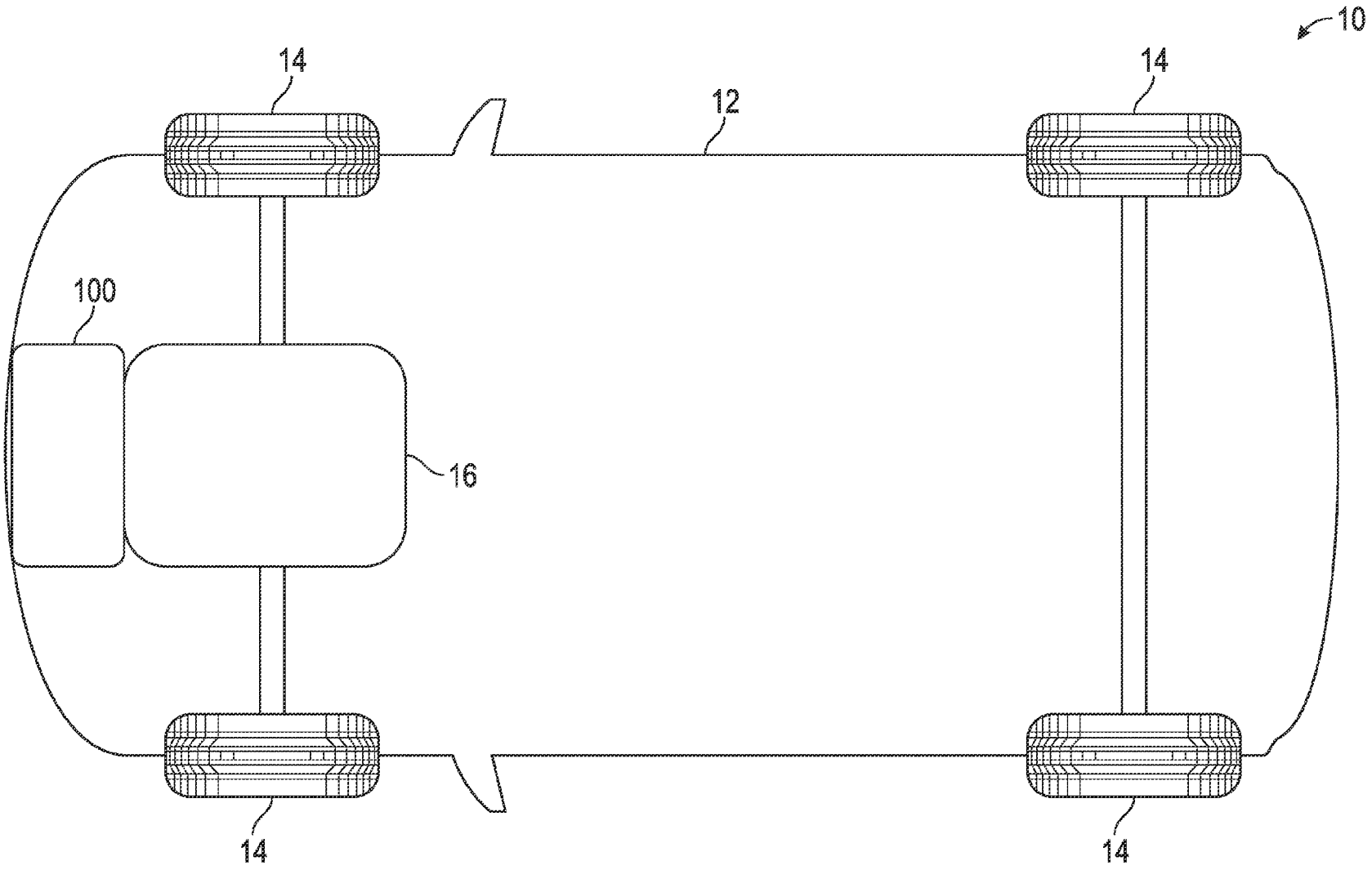
FIG. 1 is a schematic diagram of a vehicle including an engine and a CRFM in accordance with an embodiment of the present disclosure, wherein the CRFM is operatively coupled to the engine.

Referring now to the drawings, wherein the like numerals indicate corresponding parts throughout the several views, FIG. 1 schematically illustrates a vehicle 10, such as a car, including a vehicle body 12 and a plurality of wheels 14 operatively coupled to the vehicle body 12. The vehicle 10 further includes an engine 16, such as an internal combustion engine, operatively coupled to the wheels 14. The engine 16 is disposed within the vehicle body 12 and is configured to propel the vehicle 10 via the wheels 14. The vehicle 10 further includes a condenser, radiator, and fan module (CRFM) 100 operatively coupled to the vehicle body 12 and the engine 16. The CRFM 100 is operatively coupled to the vehicle body 12 and the engine 16 such that the engine 16 can move relative to the vehicle body 12.

Figure 2:
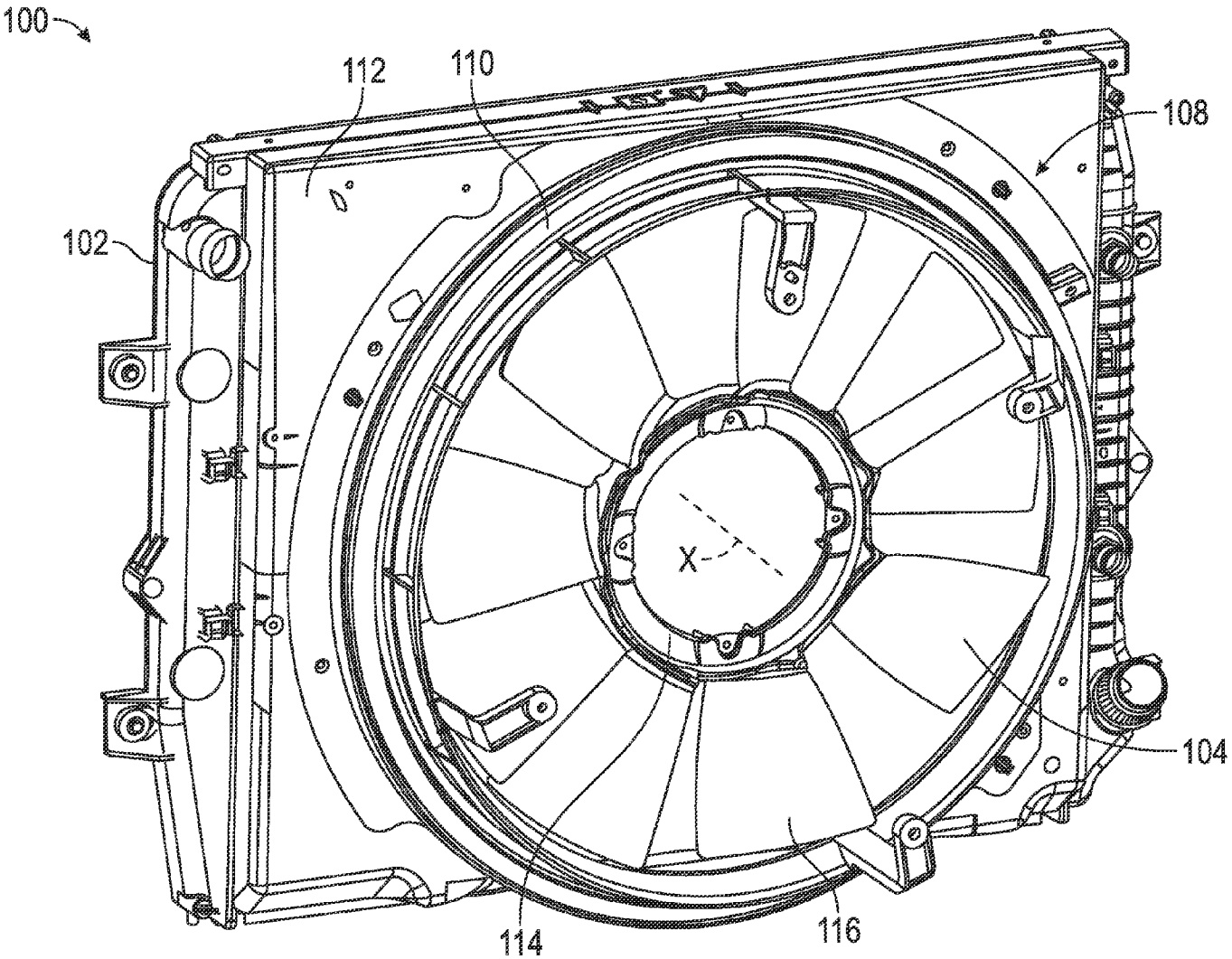
FIG. 2 is a schematic perspective view of a CRFM in accordance with an embodiment of the present disclosure.
Figure 3:
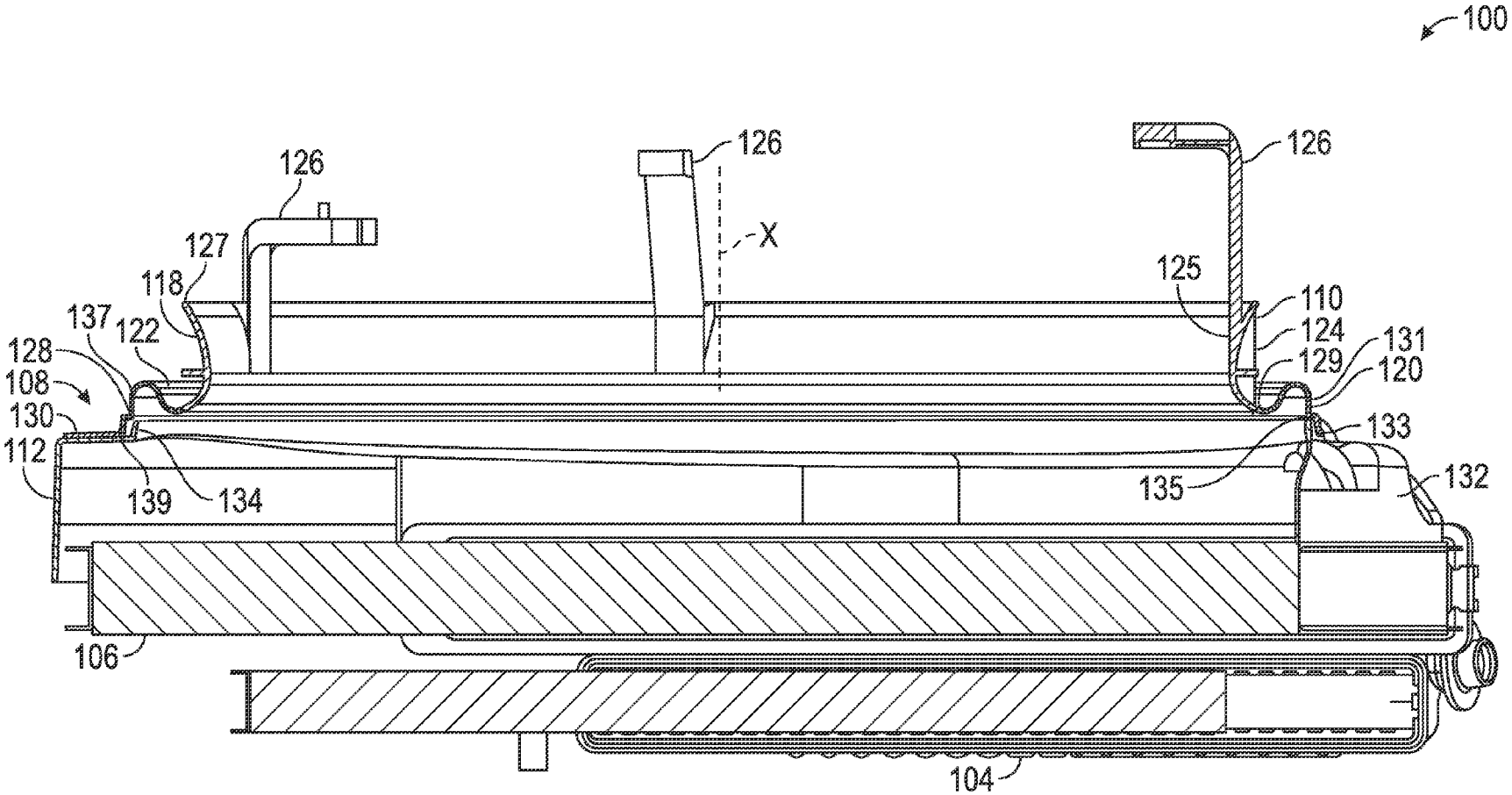
FIG. 3 is a schematic cross-sectional side view of the CRFM shown in FIG. 2 in an installed position without a fan.
Figure 4:
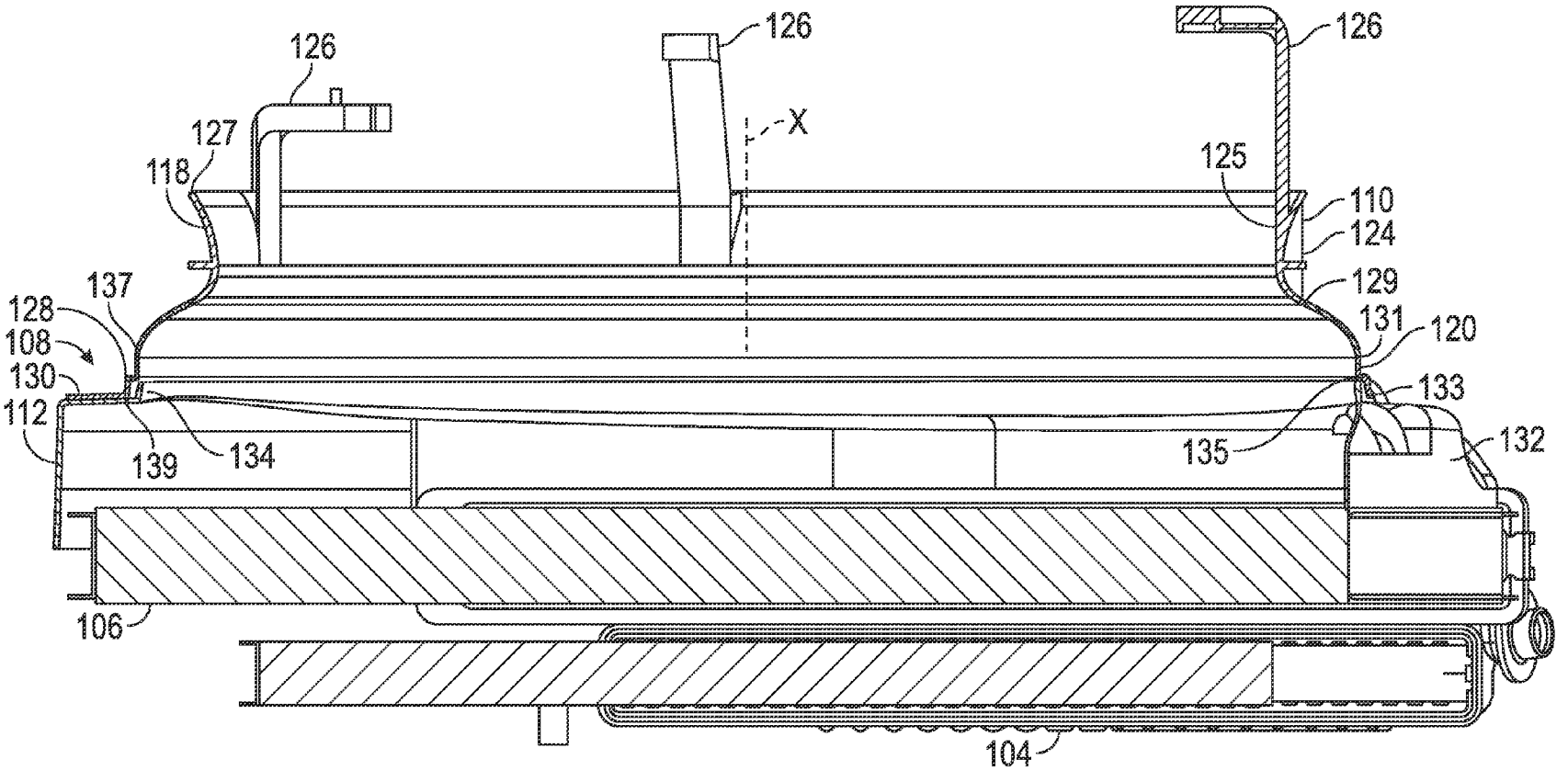
FIG. 4 is a schematic cross-sectional side view of the CRFM shown in FIG. 2 in a pre-installed position without the fan.

With reference to FIGS. 2-4, the CRFM 100 includes a radiator 102 (or another kind of heat exchanger), a fan 104, a radiator support structure 106 (FIG. 3) coupled to the radiator 102, and a fan shroud assembly 108 coupled to the radiator support structure 106. The radiator 102 is fixed to the vehicle body 12 (FIG. 1). The fan 104 is operatively coupled to the engine 16. As such, the fan 104 can be driven by the engine 16. The fan 104 includes a central ring 114 operatively coupled to the engine 16 and a plurality of blades 116 coupled to the central ring 114. During operation, the blades 116 can rotate about a rotation axis X in order to generate gas flow (e.g., airflow). Moreover, the fan 104 is at least partially covered by the fan shroud assembly 108.

The fan shroud assembly 108 includes a first fan shroud 110, which is mounted to the engine 16 (FIG. 1) and a second fan shroud 112, which is mounted to the radiator 102 via the radiator support structure 106. Because the first fan shroud 110 is mounted to the engine 16, the first fan shroud 110 may be referred to as the engine mounted fan shroud. Because the second fan shroud 112 is mounted to the radiator 102 via the radiator support structure 106, the second fan shroud 112 may be referred to as the radiator mounted fan shroud. The second fan shroud 112 may also be referred to as the plenum.

The first fan shroud 110 includes a first segment 118, a second segment 120, and a flexible, gas impermeable seal 122 interconnecting the first and second segments 118, 120. The first segment 118, second segment 120, and flexible, gas impermeable seal 122 are integrally coupled to one another so as to collectively form a one-piece structure. The first and second segments 118, 120 may be wholly or partly made of materials (i.e., the first and second materials, respectively) that have a stiffness that is greater than the stiffness of the material (i.e., a third material) partially or entirely forming the flexible, gas impermeable seal 122.

In the depicted embodiment, the first segment 118 completely surrounds the fan 104 and has a substantially annular shape. The first segment 118 may be wholly or partly made of a substantially rigid material (e.g., hard polymer such as nylon) and includes an annular body (or ring) 124. Furthermore, the first segment 118 includes at least one bracket 126 extending from the annular body 124. In the depicted embodiment, the first segment 118 includes a plurality of brackets 126 extending from the annular body 124. The brackets 126 may be directly coupled to the engine 16 (FIG. 1). The annular body 124 serves as a diffuser and may therefore be referred to as the diffuser. Accordingly, the first segment 118 can direct the flow of a gas (e.g., air) into the blades 116 of the fan 104. In the depicted embodiment, the annular body 124 defines a first circumferential edge 127 and a second circumferential edge 129 spaced from the first circumferential edge 127 along the rotation axis X. The flexible, gas impermeable seal 122 is coupled to the first segment 118 along the entire second circumferential edge 129 of the annular body 124. In other words, the flexible, gas impermeable seal 122 is coupled to the annular body 124 along an entirety of its second circumferential edge 129. The annular body 124 completely encircles the fan 104. As such, the fan 104 is disposed within the first segment 118. In particular, the annular body 124 defines a fan opening 125 configured, shaped, and sized to receive the fan 104. The engine 16 (FIG. 1) can be directly coupled to the first segment 118 via the brackets 126.

The second segment 120 is integrally coupled to the flexible, gas impermeable seal 122 and is directly coupled to the second fan shroud 112. Further, the second segment 120 is made of a substantially rigid material (i.e., the second material) that has a stiffness that is greater than the stiffness of the material (i.e., third material) entirely or partly forming the flexible, gas impermeable seal 122. The material (i.e., the second material) partially or entirely forming the second segment 120 may be the same as the material (i.e., the first material) partially or entirely forming the first segment 118. Accordingly, the material (i.e., the second material) partially or entirely forming the second segment 120 may have the same stiffness as the material (i.e., the first material) partially or entirely forming the first segment 118.

In the depicted embodiment, the second segment 120 includes a circumferential connecting wall 128 and a substantially planar flange 130 extending from the circumferential connecting wall 128. The circumferential connecting wall 128 includes a first wall segment 131, a second wall segment 133, and a step 135 interconnecting the first and second wall segments 131, 133. The step 135 is substantially perpendicular to the first and second wall segments 131, 133. Moreover, the circumferential connecting wall 128 defines a first circumferential edge 137 at the first wall segment 131 and a second circumferential edge 139 at the second wall segment 133. The flange 130 is coupled to the circumferential connecting wall 128 along the entire second circumferential edge 139 at the second wall segment 133. The flexible, gas impermeable seal 122 is coupled to the second segment 120 along the entire first circumferential edge 137 of the circumferential connecting wall 128. In other words, the flexible, gas impermeable seal 122 is coupled to the second segment 120 along an entirety of the first circumferential edge 127 of the circumferential connecting wall 128. The circumferential connecting wall 128 and the flange 130 are disposed on the second fan shroud 112. The flange 130 is substantially perpendicular to the circumferential connecting wall 128 and is coupled to the circumferential connecting wall 128 along the entire second circumferential edge 139. In other words, the flange 130 is coupled along an entirety of the second circumferential edge 139 of the circumferential connecting wall 128. The second segment 120 is disposed around the fan 104. Accordingly, the second segment 120 completely surrounds the fan 104.

The flexible, gas impermeable seal 122 may be a baffle and is integrally coupled to the first segment 118 and the second segment 120 so as to form a one-piece structure. For example, the flexible, gas impermeable seal 122 may be molded with the first segment 118 and the second segment 120. Regardless of how it is manufactured, the flexible, gas impermeable material 122 is wholly or partly made of a flexible, gas impermeable material (i.e., the third material) such as a flexible polymer (e.g., rubber). As a non-limiting example, the flexible, gas impermeable seal 122 may be wholly or partly made of a thermoplastic elastomer (TPE), such as an elastomer including a mixture of in-situ cross linking of ethylene propylene diene monomer (M-class) rubber (i.e., EPDM rubber) and polypropylene. Irrespective of the specific material employed, the flexible, gas impermeable seal 122 is wholly or partly made of a material (i.e., the third material) that has a stiffness that is less than the stiffness of the materials partially or entirely forming the first segment 118 and second segment 120. When the CRFM 100 is mounted between the vehicle body 12 and the engine 16, the flexible, gas impermeable seal 122 has an undulated shape (e.g., sinuous shape or wavelike shape) as shown in FIG. 3. As a non-limiting example, the flexible, gas impermeable seal 122 may have a substantially S-shape. However, when the CRFM 100 is not mounted to the engine 16, the flexible, gas impermeable seal 122 may have a curved, albeit not undulated, shape as shown in FIG. 4. When the CRFM 100 is mounted between the vehicle body 12 and the engine 16, the flexible, gas impermeable seal 122 minimizes gas loss (air loss) in the CRFM 100. The flexibility of the flexible, gas impermeable seal 122 facilitates installation of the CRFM 100 in the vehicle 10. In addition, the flexibility of the flexible, gas impermeable seal 122 allows the engine 16, which is coupled to the first fan shroud 110, to move relative to the vehicle body 12 and the radiator 102, which is coupled to the second fan shroud 112.

The second fan shroud 112 is coupled to the second segment 120 and includes a substantially hollow shroud body 132 and a circumferential support wall 134 extending from the shroud body 132. In the depicted embodiment, the flange 130 is disposed on the shroud body 132, and the circumferential connecting wall 128 is disposed on the circumferential support wall 134 such that the circumferential connecting wall 128 completely surrounds the circumferential support wall 134. The second fan shroud 112 is wholly or partly made of a substantially rigid material, such as a rigid polymer, and is coupled to the vehicle body 12 via the radiator 104 and the radiator support structure 106. Specifically, the second fan shroud 112 is coupled to the radiator 102 via the radiator support structure 106. The radiator support structure 106 may be a plate, such as a metal plate.

During the operation of the vehicle 10, the first fan shroud 110 moves with the engine 16, whereas the second fan shroud 112 moves with the vehicle body 12. As a consequence, the first fan shroud 110 can move relative to the second shroud 112. As the first fan shroud 110 moves relative to the second fan shroud 112, the flexible, gas impermeable seal 122 may bend while still interconnecting the first and second segments 118, 120. The flexible, gas impermeable seal 122 minimizes airflow generated by the fan 104 from recirculating by flowing between the first fan shroud 110 and the second fan shroud 112.

While the best modes for carrying out the invention have been described in detail, those familiar with the art to which this invention relates will recognize various alternative designs and embodiments for practicing the invention within the scope of the appended claims.

The invention claimed is:

1. A condenser, radiator, and fan module (CRFM), comprising:

a first fan shroud including a first segment, a second segment, and a flexible, gas impermeable seal interconnecting the first and second segments, wherein the first segment includes an annular body, the annular body defines a first circumferential edge and a second circumferential edge, the flexible, gas impermeable seal is coupled to the first segment along an entirety of the second circumferential edge of the annular body, the second segment includes a circumferential connecting wall and a flange extending from the circumferential connecting wall, the circumferential connecting wall includes a first circumferential edge and a second circumferential edge, the flexible, gas impermeable seal is coupled to the second segment along an entirety of the first circumferential edge of the circumferential connecting wall, and the flange is coupled to the circumferential connecting wall along an entirety of the second circumferential edge of the circumferential connecting wall;

a second fan shroud coupled to the second segment, wherein the second fan shroud includes a shroud body and a circumferential support wall extending from the shroud body, the flange is disposed on the shroud body, and the circumferential connecting wall is disposed on the circumferential support wall such that the circumferential connecting wall surrounds the circumferential support wall;

a fan disposed within the annular body; and a radiator coupled to the second fan shroud.

2. The CRFM of claim 1, wherein the flexible, gas impermeable seal is molded with the first and second segments.

3. The CRFM of claim 1, wherein the first segment is configured to be coupled to an engine.

4. The CRFM of claim 3, wherein the flexible, gas impermeable seal has an undulated shape when the first segment is coupled to the engine and the second fan shroud is coupled to the radiator.

5. The CRFM of claim 4, further comprising a radiator support structure, wherein the second fan shroud is coupled to the radiator via the radiator support structure.

6. The CRFM of claim 1, wherein the annular body completely surrounds the fan.

7. The CRFM of claim 1, wherein the flexible, gas impermeable seal is a baffle.

8. The CRFM of claim 1, wherein the flexible, gas impermeable seal is integrally coupled to the first segment and the second segment so as to form a one-piece structure.

9. The CRFM of claim 1, wherein the first segment is made of a first material, the second segment is made of a second material, and the first material has the same stiffness as the second material.

10. The CRFM of claim 9, wherein the flexible, gas impermeable seal is made of a third material, and a stiffness of the first and second materials is greater than a stiffness of the third material.

11. The CRFM of claim 1, wherein the flexible, gas impermeable seal 122 has an S-shape.

12. The CRFM of claim 1, wherein the fan includes a central ring and a plurality of blades coupled to the central ring, the central ring surrounds a rotation axis, and the blades are rotatable about the rotation axis.

13. A condenser, radiator, and fan module (CRFM), comprising:

a first fan shroud including a first segment, a second segment, and a flexible, gas impermeable seal interconnecting the first and second segments, the first segment including an annular body, wherein the second segment includes a circumferential connecting wall and a flange extending from the circumferential connecting wall;

a second fan shroud coupled to the second segment, wherein the flexible, gas impermeable seal is integrally coupled to the first segment and the second segment so as to form a one-piece structure, the second fan shroud includes a shroud body and a circumferential support wall extending from the shroud body, the flange is disposed on the shroud body, and the circumferential connecting wall is disposed on the circumferential support wall such that the circumferential connecting wall surrounds the circumferential support wall;

a fan disposed within the annular body; and a radiator coupled to the second fan shroud.

14. The CRFM of claim 13, wherein the first segment is made of a first material, the second segment is made of a second material, and the flexible, gas impermeable seal is made of a third material, and the third material has a stiffness that is less than the stiffness of the first material and the second material.

15. The CRFM of claim 14, wherein the stiffness of the first material is the same as the stiffness of the second material.

* * * * *